US005091101A

United States Patent [19]

Hildreth

[11] Patent Number: 5,091,101

[45] Date of Patent: Feb. 25, 1992

[54] DETERGENT COMPOSITION CONTAINING C5-C14 FREE FATTY ACIDS AND ONE OR MORE SURFACTANT

[76] Inventor: Eslie D. Hildreth, 13108 Amity Rd., Fredericktown, Ohio 43019

[21] Appl. No.: 486,168

[22] Filed: Feb. 28, 1990

[51] Int. Cl.[5] ..... C11D 9/22; C11D 15/04

[52] U.S. Cl. ..... 252/89.1; 252/132; 252/174.21; 252/174.22

[58] Field of Search ..... 252/89.1, 132, 174.21, 252/174.22

[56] References Cited

U.S. PATENT DOCUMENTS

| | | | |
|---|---|---|---|
| 3,208,949 | 9/1965 | Rosnati | 252/109 |
| 3,850,834 | 11/1974 | Hellsten | 252/117 |
| 3,870,647 | 3/1975 | Travers | 252/118 |
| 3,953,351 | 4/1976 | Keller | 252/132 |
| 3,953,382 | 4/1976 | Nelson | 252/548 |
| 3,972,823 | 8/1976 | Howarth | 252/132 |
| 4,058,473 | 11/1977 | Canter | 252/121 |
| 4,285,841 | 8/1981 | Barrat | 252/559 |
| 4,286,956 | 9/1981 | Bechstedt | 8/137 |
| 4,288,225 | 9/1981 | Roland | 8/137 |

*Primary Examiner*—A. Lionel Clingman
*Assistant Examiner*—William S. Parks
*Attorney, Agent, or Firm*—Renner, Kenner, Greive, Bobak, Taylor & Weber

[57] ABSTRACT

A composition useful as a laundry detergent having from about 95 to about 5 percent by weight of a first component and from about 5 to about 95 percent by weight of a second component. The first component contains one or more short chain fatty acids having from 5 to about 14 carbon atoms, and the second component contains one or more surfactants. A method of laundering sullied fabrics is also presented which includes preparing a laundering solution of from about 0.2 to about 0.75 percent by weight of the above detergent composition, from about 0.0 to about 1.3 percent by weight of an alkaline constituent and enough water to equal 100 percent by weight. The laundering solution is then employed in a conventional washing machine in order to remove the sullying materials from the fabric.

3 Claims, No Drawings

DETERGENT COMPOSITION CONTAINING C5-C14 FREE FATTY ACIDS AND ONE OR MORE SURFACTANT

TECHNICAL FIELD

The subject invention relates generally to detergent compositions. More particularly, the present invention is directed toward detergent compositions employing short chain fatty acids and surface active agents. Specifically, the present invention relates to a composition for use in laundry operations which will produce a plurality of small, resilient and tenacious bubbles which prevent redeposition of sully materials onto laundered fabrics.

BACKGROUND OF THE INVENTION

The present invention is directed toward detergent compositions which may be employed to clean or remove sullying materials from soiled fabrics, fibers or other raw and finished textiles (hereinafter collectively referred to as "fabrics"), without leaving behind a film residue, or other material which will discolor the fabric or leave an odor.

Previous types of laundry compositions have included perfumes and photoinhibitors (such as fluorescent materials) which mask or cover up odors and soils. These compositions do not clean fabrics in that the sullying materials which produce odors and discolorations are still present, even if not readily observable. Over time, these materials build up on the fabric where they may be felt, giving the fabric an undesirable stiffness. Such build-up is known to cause fabric to be sensitive to excessive scorching when pressed. Further, in the case of fabrics used as table napkins and the like, the fabric may even develop a sour odor from sebaceous oils or other redeposited soils. With these types of laundry detergents it is not known how "clean" is "clean" because the soils are masked and not removed.

The inefficiency of the compositions that cover over sullying materials is more pronounced with the materials that are the most difficult to remove from fabric. These include fats, heavy oils, metal stains and dyes. If these materials are not removed but are only masked, they will degrade the fabric in a short time.

It is desirable to have a detergent composition to clean soiled fabrics which will soften the fabric and increase the fabric whiteness. Further, a laundry detergent should provide anticling and antistatic action. The composition should be capable of lifting the sullying materials from the fabric as well as preventing their redeposition thereto.

Heretofore, it has been known in the art to provide cleaning detergent compositions with a surface active agent or "surfactant". Further, it has been found that a long chain fatty acid (having 16 or more carbon atoms) will increase fabric softening. However, the long chain fatty acids are known to leave behind an undesirable film residue.

During laundry operations, sullying materials such as soils, oils and the like, are lifted or "cracked" from the fabric. It is desirable for a detergent composition to prevent the redeposition of the sullying materials, back onto the fabric. It is known that the suds layer, or layer of bubbles produced by laundry detergents, helps to prevent the redeposition of the sullying materials. Heretofore, no attention has been given to the nature of the bubble layers, and no art has been specifically directed toward improving the nature and quality thereof with respect to preventing redeposition of sullying materials.

DISCLOSURE OF THE INVENTION

It is therefore, a primary object of the present invention to provide a laundry detergent composition which will provide improved cleaning of soiled fabrics.

It is another object of the present invention to provide a laundry detergent composition which will not leave residues or other sullying materials on the fabric which are observable by either sight, touch, smell, or taste.

It is a further object of the present invention to provide a laundry detergent composition which will exhibit improved fabric whitening properties.

It is still another object of the present invention to provide a laundry detergent composition which will provide improved antistatic action.

It is yet another object of the present invention to provide a laundry detergent composition which will produce a thin layer of small, tenacious bubbles during a wash cycle.

It is a still further object of the present invention to provide an improved method of laundering sullied fabrics.

These and other objects of the invention, as well as the advantages thereof over existing and prior art forms, which will become apparent in view of the following specification are accomplished by means hereinafter described and claimed.

A laundry detergent composition according to the present invention has from about 95 to about 5 percent by weight of a first component and from about 5 to about 95 percent by weight of a second component. The first component contains one or more fatty acids having from 5 to about 14 carbon atoms. The second component contains one or more surface active agents.

A method of laundering sullied fabric is also provided and comprises the step of preparing a detergent composition. The detergent composition has from about 95 to about 5 percent by weight of a first component and from about 5 to about 95 percent by weight of a second component. The first component contains one or more fatty acids having from 5 to about 14 carbon atoms. The second component contains one or more surface active agents. The method also includes the step of preparing a laundering solution of from about 0.2 to about 0.75 percent by weight of the detergent composition, from about 0.0 to about 1.3 percent by weight of an alkaline constituent, and enough water to equal 100 percent by weight. The next step includes placing the fabric and the laundering solution into a conventional washing machine and engaging the washing machine in a wash cycle. The solution reacts to form a plurality of resilient and tenacious bubbles which prevent the redeposition of the sullying materials onto the fabric.

EXEMPLARY EMBODIMENT OF THE INVENTION

The present invention is directed toward a composition of matter useful as a laundry detergent and employing short chain fatty acids and surface active agents or "surfactants".

It has been found that when one or more surfactants are combined in a composition with one or more short chain fatty acids, an increase in the cleaning, whitening and softening action of the composition is achieved when used to clean soiled fabrics. Long chain fatty acids (fatty acids having 16 or more carbon atoms) are known which provide improved whitening characteristics. However, it has been found that the long chain fatty acids deposit a film residue on the subject fabric. These residues may discolor the fabric, leave an odor on the fabric, and leave the fabric with a sleazy, crisp and rigid feel. Further, it has been found that when fabrics are cleaned with detergent compositions containing long chain fatty acids, the fabric has a propensity to be scorched when pressed.

A composition according to the present invention has from about 95 to about 5 percent by weight of a first component and from about 5 to about 95 percent by weight of a second component. The first component contains one or more short chain fatty acids selected from the group consisting of acids having from 5 to about 14 carbon atoms, and the second component contains one or more surfactants.

Exemplary of the short chain fatty acids useful in the practice of the present invention include the acids valeric, caproic, enanthic, caprylic, pelargonic, capric, lauric and myristic. These acids represent a group which contains from 5 to about 14 carbon atoms.

The short chain fatty acids have the characteristic of functioning in a high alkali media of pH from 7 to about 14. At these pH levels, the short chain fatty acids readily saponify. The saponified acids have the voracious capacity to crack and solubilize the hard and resistant sullying materials often associated with soils, blood stains, oil spots and the like. The present composition affects the sullying materials such that they are subject to being emulsified. The saponification reaction produces a plurality of small, resilient and tenacious bubbles which are a key factor to particulate matter suspension, as will be discussed hereinbelow.

As is known in the art, a catalyst may be added to the laundry detergent solution in order to further promote the production of bubbles. Examples of such catalysts include alkylolamides, alkylolamines and alkyl sulfates. The addition of a catalyst is not necessary to the operation of the present invention.

It is known in the art to provide detergent compositions with surfactants. Examples of such surfactants are described in U.S. Pat. No. 4,759,877, which is hereby fully incorporated by reference with respect to such surfactants. Further, reference is made to McCutcheon, *Detergents and Emulsifiers,* 1979 North American Edition, Glen Rock, N.J., which is also hereby fully incorporated by reference with respect to surfactants. Still a further reference listing various surfactants is the *CTFA Cosmetic Ingredient Dictionary,* 3rd Edition, published by the Cosmetic, Toiletry and Fragrance Association, Inc., Washington, D.C. (1982), which is also fully incorporated by reference with respect to surfactants.

While any of the known surfactants have a usefulness to the present invention, it is preferred to use either an anionic or a nonionic surfactant. Exemplary of known surfactants which may be employed in the present invention include TERGITOL produced by Union Carbide. These surfactants are based upon nonylphenol ethoxylates having the general formula

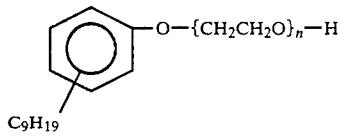

wherein the subscript n is an integer of from about 4 to about 40. Other surfactants which may be found in one or more of the materials incorporated by reference include polyethyleneoxide condensates of alkyl phenols, condensation products of aliphatic alcohols with from about 1 to about 25 moles of ethylene oxide, condensation products of ethylene oxide with a hydrophobic base formed by the condensation of propylene oxide with propylene glycol, condensation products of ethylene oxide with the reaction product of propylene oxide and ethylenediamine, water-soluble amine oxides, water soluble phosphine oxides, water soluble sulfoxides, alkylpolysaccharides and fatty acid amides having the general formula

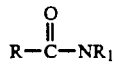

where R is an alkyl group containing from about 7 to about 21 (preferably from about 9 to about 17) carbon atoms, and $R_1$ is selected from the group consisting of hydrogen, $C_1$-$C_4$ alkyl, $C_1$-$C_4$ hydroalkyl and $(C_2H_4O)_xH$ where "x" is an integer from 1 to about 3.

The present detergent composition, when placed into solution with water and an alkaline constituent, produces a thin layer of suds or bubbles. It has been found that these bubbles are resilient and tenacious. That is, the bubbles are strong enough to withstand the agitation encountered during a wash cycle in a conventional home or industrial washing machine. During the wash cycle, the sullying materials are lifted from the fabric due to the change in surface tension provided by the short chain fatty acids and the surfactants. The present invention prevents the redeposition of the sullying materials back onto the fabric by the action of being suspended by the small tenacious bubbles.

In use, as with other laundry detergent compositions, a quantity of the composition may be added to a quantity of an alkaline constituent, such as sodium orthosilicate. The mixture is placed into a washing machine, a quantity of water is introduced into the machine, and a wash cycle is engaged. The addition of the alkali constituent results in the saponification reaction described above, with the consequential production of the small, tenacious bubbles.

It is to be appreciated that while the present invention has application to use with alkali constituents, it has equal applicability and usefulness in acidic solutions, and the example to follow wherein an alkali constituent is employed is merely exemplary. In use however, the useful alkaline constituents include those which are water soluble and active.

It is further to be appreciated that the present composition does not incorporate nor does it require the addition of phosphate constituents. The composition is completely biodegradable.

GENERAL EXPERIMENTAL

In order to demonstrate the practice of the present invention, three detergent compositions were prepared according to the following formulations:

EXAMPLE NO. 1

| First Component | Amounts[a] | Second Component | Amounts[a] |
|---|---|---|---|
| valeric acid | 4 | nonylphenol ethoxylate-6[b] | 50 |
| caproic acid | 25 | | |
| enanthic acid | 32 | nonylphenol ethoxylate-9[c] | 50 |
| caprylic acid | 8 | | |
| pelargonic acid | 29 | | 100 |
| capric acid | 2 | | |
| | 100 | | |

Thirty-nine ounces of nonylphenol ethoxylate-6 and thirty-nine ounces of nonylphenol ethoxylate-9 were added to 50 ounces of the first component.

EXAMPLE NO. 2

| First Component | Amounts[a] | Second Component | Amounts[a] |
|---|---|---|---|
| caprylic acid | 60 | nonylphenol ethoxylate-6[b] | 60 |
| pelargonic acid | 40 | | |
| | 100 | nonylphenol ethoxylate-9[c] | 40 |
| | | | 100 |

To formulate the first component, 18 ounces of caprylic acid were added to 12 ounces of pelargonic acid. Forty-two ounces of nonylphenol ethoxylate-6[b] were added to 28 ounces of nonylphenol ethoxylate-9[c], to formulate the second component.

EXAMPLE NO. 3

| First Component | Amounts[a] | Second Component | Amounts[a] |
|---|---|---|---|
| caprylic acid | 50 | nonylphenol ethoxylate-6[b] | 50 |
| pelargonic acid | 50 | | |
| | 100 | nonylphenol ethoxylate-9[c] | 50 |
| | | | 100 |

To formulate the first component, approximately equal parts by weight of two short chain fatty acids, namely 20 ounces of caprylic acid and 20 ounces of pelargonic acid were added to approximately equal parts by weight of two surfactants, namely 32 ounces of nonylphenol ethoxylate-6[b] and 32 ounces of nonylphenol ethoxylate-9[c].

In the foregoing examples, superscript "a" refers to approximate percent by weight; "b" refers to nonylphenol ethoxylate containing 6 moles of ethylene oxide and; "c" refers to nonylphenol ethoxylate containing 9 moles of ethylene oxide.

In addition to the compositions of the first component as shown in Example Nos. 1-3, other useful first components included one having about 1.5 parts by weight of a fatty acid having 6 carbon atoms, about 78 parts by weight of a fatty acid having 8 carbon atoms, about 20 parts by weight of a fatty acid having 10 carbon atoms, and about 0.5 parts by weight of a fatty acid having 12 carbon atoms. Another useful first component included one having about 1.5 parts by weight of a fatty acid having 6 carbon atoms, about 28 parts by weight of a fatty acid having 8 carbon atoms, about 50 parts by weight of a fatty acid having 9 carbon atoms, and about 0.5 parts by weight of a fatty acid having 12 carbon atoms.

Although all three of Example Nos. 1-3 above showed improved cleaning abilities when used in a laundry operation, and although all three are within the scope of the present invention, Example No. 3 is preferred for the most heavily soild of fabrics. In order to more fully demonstrate the usefulness of this composition, a laundry detergent according to Example No. 3 was tested against a commercial laundry detergent. The tests were completed by the International Fabricare Institute of Silver Springs, Md.

According to the test procedures, pieces of fabric having the same medium degree of soil content were cleaned in each of the cleaning compositions. The fabrics were then analyzed for a number of factors including degree of whiteness, yellowness, blood stain removal, soil removal and tensile strength loss. Each factor was assigned a number corresponding to that determined from the cleaned fabric. It is generally accepted in the industry, that for degree of whiteness, a number of over 109 is considered excellent while that of 91 or less is considered poor. Similarly, for yellowness, a number of less than −4.3 is excellent while anything over −0.4 is poor; for blood stain removal, over 47 is excellent while 17 or less is poor; for soil removal, over 36 is excellent and 23 or less is poor; and, for tensile strength loss, when laundering fabric having a medium degree of soil content, a loss of 10% or less is satisfactory and acceptable.

Similarly soiled pieces of cloth were cleaned in a laundry detergent produced by Diamond Chemical of Lyndhurst, N.J., and a solution according to Example No. 3 above. The test pieces of cloth were heavily soiled. To the composition of Example No. 3 was added 16 ounces TMN-6, a surfactant produced by Union Carbide, and about 3.4 kilograms of sodium orthosilicate. Both the commercial cleaner and the present invention as in Example No. 3 above were then tested according to the International Fabricare Institute procedures described above. The results of these tests are reported in Table I below.

TABLE I

| | Comparison Test Results | | | | |
|---|---|---|---|---|---|
| Cleaning Composition | Whiteness | Yellowness | Blood | Soil | Tensile |
| Diamond Chemical | 113.2 | −5.7 | 75.9 | 39.1 | 1% |
| Example No. 3 | 131.4 | −9.0 | 104.7 | 42.8 | 8% |

The results as reported in Table I above, show that a composition according to the present invention has improved cleaning abilities when compared to cleaning compositions known in the art. Further, it has been found, that when employed in a standard commercial laundry operation, the number of steps employed to clean similarly soiled fabrics was reduced by as much as 30 percent. As much as 80 percent of the costs involved in commercial laundry operations involves the heating of water. By decreasing the number of steps required, and hence, the amount of hot water used in a laundry cycle, the present invention results in a direct and proportional savings in time, effort and money for the commercial laundry. The most such savings will be encountered with more heavily soiled fabrics which require laundering.

In addition to the examples provided above, which are directed toward compositions having two or more short chain fatty acids and two or more surfactants, test were conducted employing one short chain fatty acid and one surfactant. These tests were conducted using a standard commercial laundry machine, and typical, heavily soiled fabric articles. Specifically, test loads of counter towels and bib aprons, commonly recognized in the industry as having the heaviest of sullying materials therein, were laundered using a formula according to the present invention and having one short chain fatty acid and one surfactant.

The test loads were then inspected for percent of "rejects", or those articles which were not sufficiently cleaned and which would have to be laundered again in order to meet quality control standards. It is generally accepted in the industry that a 10 percent amount of rejects per laundry load is considered good.

Table II below shows the percent of rejects for the counter towel and bib apron test loads for each of the short chain fatty acids tested. The surfactants employed varied among those disclosed above, and all of the surfactants so disclosed are considered useful.

TABLE II

Quality Control Test Results

| Short Chain Fatty Acid | Percent of Rejects |
|---|---|
| Valeric | 2-3 |
| Caproic | 1-2 |
| Enanthic | 1-2 |
| Caprylic | 1-2 |
| Pelargonic | 1-2 |
| Capric | 3-4 |
| Lauric | 5-7 |
| Myristic | 5-7 |

All of the test results in TABLE II show a percent of reject less than the industry accepted standard of 10 percent. Caproic, enanthic, caprylic and pelargonic acids are preferred based upon the test data.

It should be evident that a composition, solution and method according to the present invention, accomplishes the objects of the invention as herein described and claimed, and otherwise constitutes an advantageous contribution to the art.

The examples provided herein are illustrative of certain properties and are not to be construed as limiting practice of the invention. It is to be understood that any variations evident fall within the scope of the claimed invention, and that the specific selection of composition constituents can be determined without departing from the spirit of the invention herein described and claimed. Moreover, the scope of the invention shall include all modifications and variations that may fall within the scope of the attached claims.

I claim:

1. A composition of matter suitable for use as a laundry detergent, the composition comprising:

from about 95 to about 5 percent by weight of a first component and from about 5 to about 95 percent by weight of a second component;

said first component containing about 1.5 parts by weight of a fatty acid having 6 carbon atoms, about 78 parts by weight of a fatty acid having 8 carbon atoms, about 20 parts by weight of a fatty acid having 10 carbon atoms, and about 0.5 parts by weight of a fatty acid having 12 carbon atoms; and said second component containing one or more surface active agents selected from the group consisting of surface active agents having the general formula

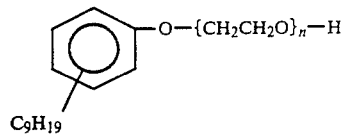

wherein the subscript n is an integer of from about 4 to about 40; condensation products of aliphatic alcohols with from about 1 to about 25 moles of ethylene oxide, condensation products of ethylene oxide with a hydrophobic base formed by the condensation of propylene oxide with propylene glycol, condensation products of ethylene oxide with the reaction product of propylene oxide and ethylenediamine, water-soluble amine oxides, water soluble phosphine oxides, water soluble sulfoxides, alkylpolysaccharides and fatty acid amides having the general formula

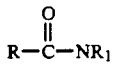

where R is an alkyl group containing from about 7 to about 21 (preferably from about 9 to about 17) carbon atoms, and $R_1$ is selected from the group consisting of hydrogen, $C_1$-$C_4$ alkyl, $C_1$-$C_4$ hydroalkyl and $(C_2H_4O)_xH$ where "x" is an integer from 1 to about 3.

2. A composition of matter suitable for use as a laundry detergent, the composition comprising:

from about 95 to about 5 percent by weight of a first component and from about 5 to about 95 percent by weight of a second component;

said first component containing about 1.5 parts by weight of a fatty acid having 6 carbon atoms; about 28 parts by weight of a fatty acid having 8 carbon atoms; about 50 parts by weight of a fatty acid having 9 carbon atoms; about 20 parts by weight of a fatty acid having 10 carbon atoms, and about 0.5 parts by weight of a fatty acid having 12 carbon atoms; and said second component containing one or more surface active agents selected from the group consisting of surface active agents having the general formula

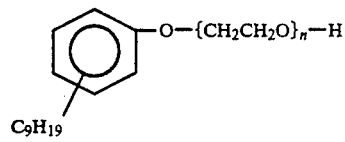

wherein the subscript n is an integer of from about 4 to about 40; condensation products of aliphatic alcohols with from about 1 to about 25 moles of ethylene oxide, condensation products of ethylene oxide with a hydrophobic base formed by the condensation of propylene oxide with propylene glycol, condensation products of ethylene oxide with the reaction product of propylene oxide and ethylenediamine, water-soluble amine oxides, water soluble phosphine oxides, water soluble sulfoxides, alkylpolysaccharides and fatty acid amides having the general formula

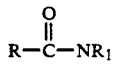

where R is an alkyl group containing from about 7 to about 21 (preferably from about 9 to about 17) carbon atoms, and $R_1$ is selected from the group consisting of hydrogen, $C_1$–$C_4$ alkyl, $C_1$–$C_4$ hydroalkyl and $(C_2H_4O)_xH$ where "x" is an integer from 1 to about 3.

3. A composition of matter suitable for use as a laundry detergent, the composition comprising:

from about 95 to about 5 percent by weight of a first component and from about 5 to about 95 percent by weight of a second component;

said first component containing about 4 parts by weight of a fatty acid having 5 carbon atoms, about 25 parts by weight of a fatty acid having 6 carbon atoms, about 32 parts by weight of a fatty acid having 7 carbon atoms, about 8 parts by weight of a fatty acid having 8 carbon atoms, about 29 parts by weight of a fatty acid having 9 carbon atoms, and about 2 parts by weight of a fatty acid having 10 carbon atoms; and said second component containing one or more surface active agents selected from the group consisting of surface active agents having the general formula

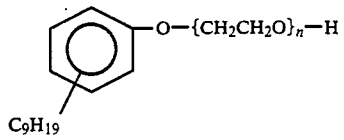

wherein the subscript n is an integer of from about 4 to about 40; condensation products of aliphatic alcohols with from about 1 to about 25 moles of ethylene oxide, condensation products of ethylene oxide with a hydrophobic base formed by the condensation of propylene oxide with propylene glycol, condensation products of ethylene oxide with the reaction product of propylene oxide and ethylenediamine, water-soluble amine oxides, water solubel phosphine oxides, water soluble sulfoxides, alkylpolysaccharides and fatty acid amides having the general formula

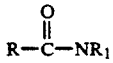

where R is an alkyl group containing from about 7 to about 21 (preferably from about 9 to about 17) carbon atoms, and $R_1$ is selected from the group consisting of hydrogen, $C_1$–$C_4$ alkyl, $C_1$–$C_4$ hydroalkyl and $(C_2H_4O)_xH$ where "x" is an integer from 1 to about 3.

* * * * *